US005613606A

United States Patent [19]

Meyer

[11] Patent Number: 5,613,606

[45] Date of Patent: Mar. 25, 1997

[54] APPARATUS FOR HOLDING MAIL

[75] Inventor: Gary M. Meyer, Hamburg, N.Y.

[73] Assignee: Quicksort, Inc., Hamburg, N.Y.

[21] Appl. No.: 539,717

[22] Filed: Oct. 5, 1995

[51] Int. Cl.[6] ..... B07C 7/04

[52] U.S. Cl. ..... 206/449; 209/702; 211/52; 211/72

[58] Field of Search ..... 206/449; 209/630, 209/702, 703, 900; 211/10, 72, 11, 73, 50, 52; 271/34, 151, 272, 275

[56] References Cited

U.S. PATENT DOCUMENTS

| | | | |
|---|---|---|---|
| 1,532,436 | 4/1925 | Musil | 206/449 |
| 1,731,950 | 10/1929 | Tanner | 211/72 X |
| 2,317,645 | 4/1943 | Ryan | 211/52 X |
| 2,360,218 | 10/1944 | Gavin | 206/449 |
| 3,003,626 | 10/1961 | Richards et al. | 206/449 |
| 4,484,685 | 11/1984 | Williams | 209/703 |
| 4,880,121 | 11/1989 | D'Elia | 209/702 |

*Primary Examiner*—Bryon P. Gehman
*Attorney, Agent, or Firm*—Howard J. Greenwald; James S. Nowak, Esq.; Gibson, McAskill & Crosby

[57] ABSTRACT

An apparatus for holding mail, which contains a first shelf, a second shelf integrally connected to and disposed above and in back of the first shelf, and slide bar devices and simultaneously connecting the apparatus to the front and side walls of a standard four-sided letter tray.

6 Claims, 5 Drawing Sheets

APPARATUS FOR HOLDING MAIL

FIELD OF THE INVENTION

A tray for holding mail to be delivered by a Letter Carrier.

BACKGROUND OF THE INVENTION

The United States Postal Service is a Governmental Corporation which competes with privates corporations, such as Federal Express and United Parcel Service. Its future growth and prosperity will depend to a large extent on how effectively it competes.

Each of the mail delivery services emphasizes how fast and efficiently they can deliver mail. The United States Postal Service, however, must deliver a mix of mail which the other services do not have to cope with, including first class letters, and second and third class materials such as magazines, advertising flyers, and the like.

In order to insure efficient performance, the materials to be delivered by the United States Postal Service are first sorted into case in which letters and "flats" are separately located; thereafter, the letter carrier will pull the letters and flats to be delivered for his particular customers and place them into a tray. "Flats" include magazines, advertising brochures, catalogs, newspapers, and the like.

Much of the mail delivered by the United States Postal Service is delivered by a letter carrier sitting in a "long lived vehicle" ("LLV") which is configured so that the letter carrier can drive up to a mail box, open it up, and insert the mail for the particular addressee into the mailbox.

The average letter carrier delivering mail in an LLV vehicle has at least about 500 addresses to deliver to. Although the letter carriers work an eight hour day, not all of their time is available for delivering the mail. After spending time in the morning sorting mail, and spending time in the afternoon on various administrative matters, no more than about 6 hours is available for actually delivering mail. Deducting about thirty minutes for the mail carrier's lunch, and another twenty minutes for breaks, no more than about 310 minutes is available for actually delivering in an LLV.

The minutes actually available for delivering mail in the LLV amounts to about 37 seconds per address. However, many of the addresses to which mail is to be delivered require substantially more than 37 seconds for mail delivery. Thus, for example, when mail for which the addressee's signature is required (such as registered mail) is to be delivered, the letter carrier must dismount from the LLV, walk to the residence of and find the addressee, and secure his or her signature. Thus, some of the addressee's (such as businesses) do not have mailboxes to which the letter carrier can drive up to in an LLV.

In practice, unless the letter carrier is able to deliver mail to the mailboxes in an average time of no more than about eighteen seconds, he will not finish his mail route on time. When the weather is bad, as it often is in applicant's home town of Hamburg, New York, it frequently becomes difficult to meet this eighteen second delivery goal.

A savings of as little as 3.6 seconds per delivery on an LLV route would be substantial and would save about 30 minutes per day for the letter carrier.

It is an object of this invention to provide a device for containing mail which will substantially reduce the time needed for a letter carrier in an LLV vehicle to deliver mail.

It is another object of this invention to provide an apparatus for holding mail which is sturdy.

It is yet another object of this invention to provide an apparatus for holding mail which be removably attached to a four-sided letter tray.

It is yet another object of this invention to provide an apparatus for holding mail which, when attached to a four sided letter tray, will hold the mail in a manner so that it does not fall out of the tray.

It is yet another object of this invention to provide an apparatus for holding mail which contains at least two shelves.

It is yet another object of this invention to provide an apparatus for holding mail which contains a three sided shelf with at least one wall whose height can be adjusted.

SUMMARY OF THE INVENTION

In accordance with this invention, there is provided an apparatus for holding mail which is comprised of a first three sided shelf, a second three-sided shelf disposed above and in back of the first three-sided shelf and attached to the first three-sided shelf, means for removably simultaneously connecting the apparatus to the front and side wall of a four sided letter tray, and means for adjusting the height of at least one of the walls of the second three-sided shelf.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
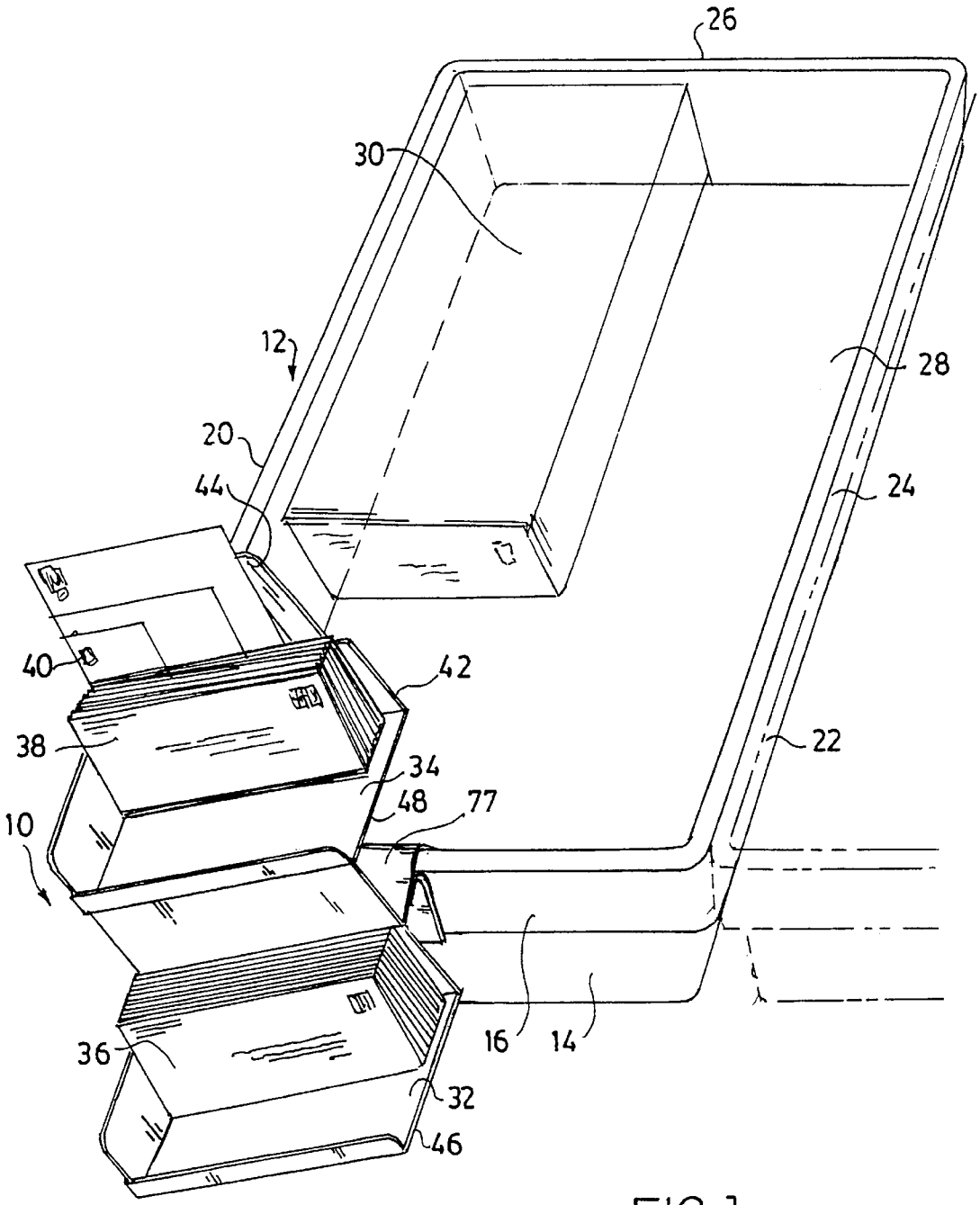
FIG. 1 is a perspective view of one preferred embodiment of applicant's letter holding tray removably connected to a four-sided letter tray.

FIG. 1 is a perspective view of one preferred embodiment of applicant's holder 10 removably attached to a four-sided letter tray 12.

The four-sided letter tray 12 is often referred to as a "mail tray". Mail trays, and devices for loading and unloading them, are known to those skilled in the art and are described, e.g., in U.S. Pat. Nos. 5,347,790, 5,329,102, 5,292,008, 5,190,282, 5,143,225, 3,863,789, design patent 272,637, and the like. The disclosure of each of these United States patents is hereby incorporated by reference into this specification.

Referring to the four-sided mail tray 12 depicted in FIG. 1, it will be seen that it is comprised of a upwardly extending front wall 14, upwardly extending front lip 16, upwardly extending left wall (not shown), upwardly extending left lip 20, upwardly extending right wall (not shown), upwardly extending right lip 24, upwardly extending back wall (not shown), upwardly extending lip 26, and bottom wall 28. As will be apparent to those skilled in the art, the four-sided letter tray 12 depicted in FIG. 1 is used in substantially very Post Office within the United States.

Referring to FIG. 1, it will be seen that letters 30 are disposed within letter tray 12. As will be apparent to those skilled in the art, letters 30 normally extend across the entire width 32 of letter tray 12. However, for simplicity and ease of representation of the structure of such tray 12, some of the mail normally present in such tray has been omitted from FIG. 1.

As will also be apparent to those skilled in the art, in addition to letters 30 magazines, advertising brochures, newspapers, and other second and third class materials are also often present within tray 12. These materials have been omitted from the depiction in FIG. 1 for simplicity of representation.

Referring again to FIG. 1, it will be seen that holder 10 is comprised of a first three-sided shelf 32 and a second three-sided shelf 34 which are joined to each other. For any particular addressee, machine-sorted letters 36 may be disposed within shelf 32, residual mail (mail that the carrier sorts at the post office in delivery sequence) may be disposed within shelf 34, and flats 40 may also be disposed within shelf 34. Shelf 34 is comprised of a composite back wall 42 whose height may be adjusted by moving extension 44 up or down.

Referring again to FIG. 1, it will be seen that the bottom walls 46 and 48 of first and second shelves 32 and 34 are not parallel to front lip 16 and/or left lip 20 but are disposed with relation thereto at an angle. As will be apparent to those skilled in the art, this arrangement helps prevent mail disposed within such shelves from falling out of the shelves during movement of the vehicle which the letter carrier is driving.

Figure 2:
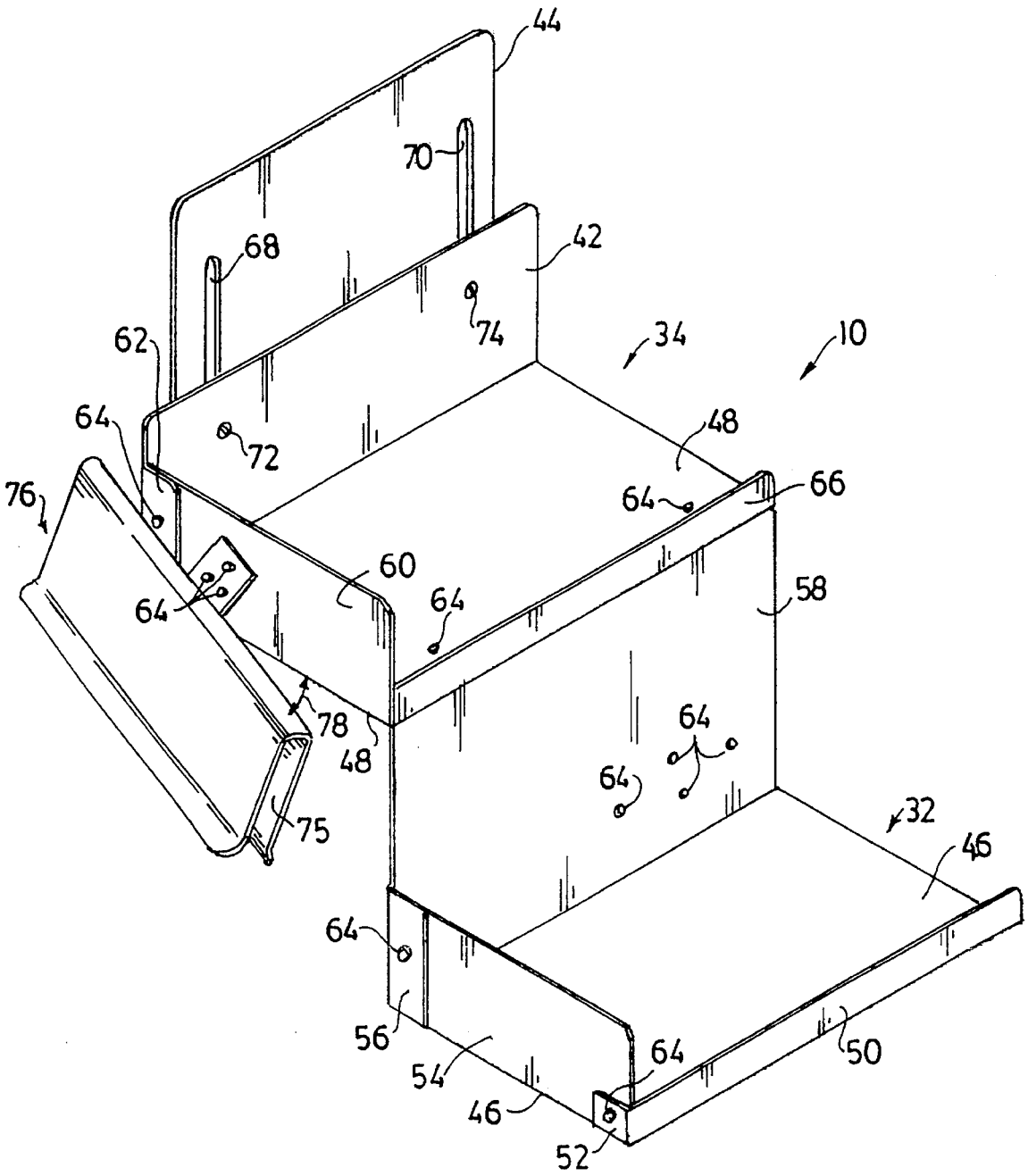
FIG. 2 is a first perspective view of the letter holding tray of FIG. 1.

FIG. 2 is a first perspective view of holder 10, taken from its left side.

It is preferred that holder 10 be made out of a lightweight metal (such as aluminum), or plastic.

In one embodiment, depicted in FIG. 2, holder 10 is made out of a metal or metal alloy such as tin, aluminum, steel, and the like. Because of of an advantageous combination of strength and light weight, aluminum is preferred. The aluminum may range in thickness from about 0.04 to about 0.25 inches; it preferably is from about 0.05 to about 0.1 inches.

The holder 10 may be constructed from aluminum by conventional forming techniques. Thus, e.g., the shelves 32 and 34 may be bent into shape by conventional sheet metal bending devices such as, e.g., those disclosed in U.S. Pat. Nos. 5,394,729, 5,295,384, 5,259,230, 5,253,501, 4,934,174, 4,489,586, 4,138,875, 4,062,216, 4,045,989, and the like. The disclosure of each of these United States patents is hereby incorporated by reference into this specification.

As will be apparent to those skilled in the art, and in the preferred embodiment depicted in FIG. 2, holder 10 is comprised of one sheet of metal which is bent to form front, upwardly extending wall 50, side upwardly extending wall 52, side upwardly extending wall 54, side upwardly extending wall 56, back upwardly extending wall 58, bottom horizontally extending wall 46, bottom horizontally extending wall 48, side upwardly extending wall 60, side upwardly extending wall 62, and back upwardly extending wall 42. In the preferred embodiment depicted, in order to afford structural rigidity, certain of these parts are joined to each other by rivets 64; the preferred rivets 64 are steel rivets. Thus, e.g., wall 52 is preferably joined to wall 54, wall 56 is preferably joined to wall 54, and wall 62 is preferably joined to wall 60 by such rivets 64.

Referring again to FIG. 2, it will be seen that shelf 32 is comprised of a front, upstanding lip which is integraly connected to side upstanding lip 52; side lip 52 is bent so that it forms an approximate ninety degree angle with front lip 50.

With regard to the lip 66 which is connected to bottom wall 48 of shelf 34, such lip 66 is not preferably integrally connected to wall 48 but is a separate part joined to wall 48 by conventional means, such as rivets.

Referring again to FIG. 2, and in the preferred embodiment depicted, slidable back portion 44 is preferably comprised of slot 68 and slot 70 within which fasteners 72 and 74 may be disposed. It will also be seen that, attached to upwardly extending wall 60 by means of rivets 64, is a means 76 for removably attaching holder 10 to upwardly extending lip 20 of letter tray 12. This preferred means 76 is a substantially U-shaped structure comprised of a slot 75. Means 76 is disposed so that it forms an acute angle with regard to bottom wall 48 of shelf 34.

Figure 3:
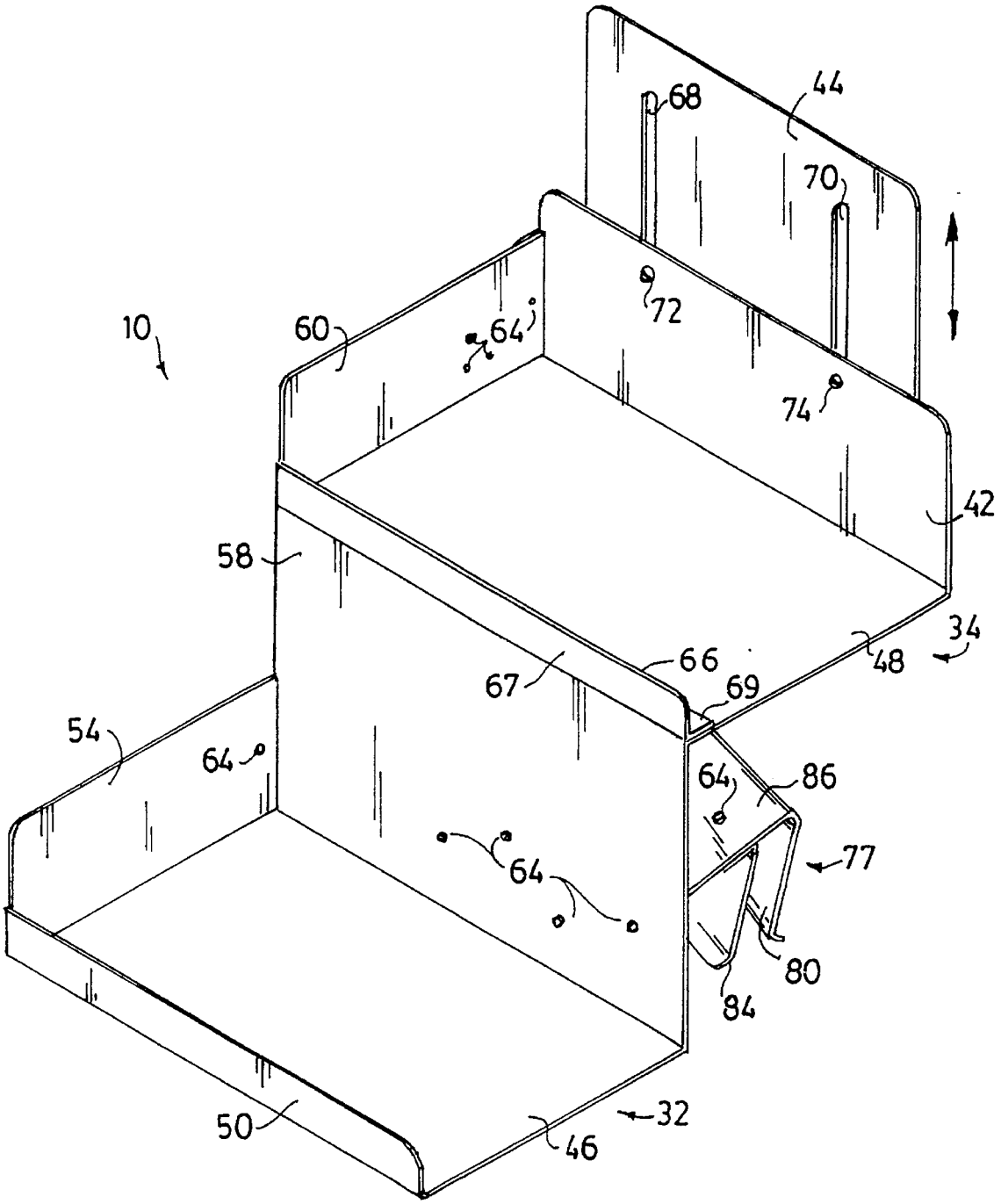
FIG. 3 is a second perspective view of the letter holding tray of FIG. 1.

FIG. 3 is a second perspective view of holder 10, taken from its right side. It will be seen that, in the embodiment depicted, lip 66 preferably is comprised of vertically extending wall 67 and horizontally extending wall 69 integrally joined to each other. It will also be seen that, in addition to means 76 for removably attaching holder 10 to upwardly extending lip 20 of letter tray 12 (not shown), there is also a means 77 for removably attaching holder 10 to upwardly extending lip 16 of letter tray 12. Attachment means 77 is secured to wall 58 of shelf 32 by means of rivets 64; and this attachment means 77 is comprised of a slot 80.

It should be noted attachment means 77 is disposed at an acute angle 82 (see FIG. 6) with respect to bottom wall 48. It is preferred that acute angle 82 be from about 10 to about 40 degrees. Referring to FIG. 2, it is preferred that acute angle 78 be from about 5 to about 40 degrees.

Referring again to FIG. 3, and in the preferred embodiment depicted therein, it will be seen that attachment 77 is comrpised of a substantailly L-shaped member 84 which is joined to top wall 86 of member 77 by rivets 64.

Figures 4, 5, 6, 7:
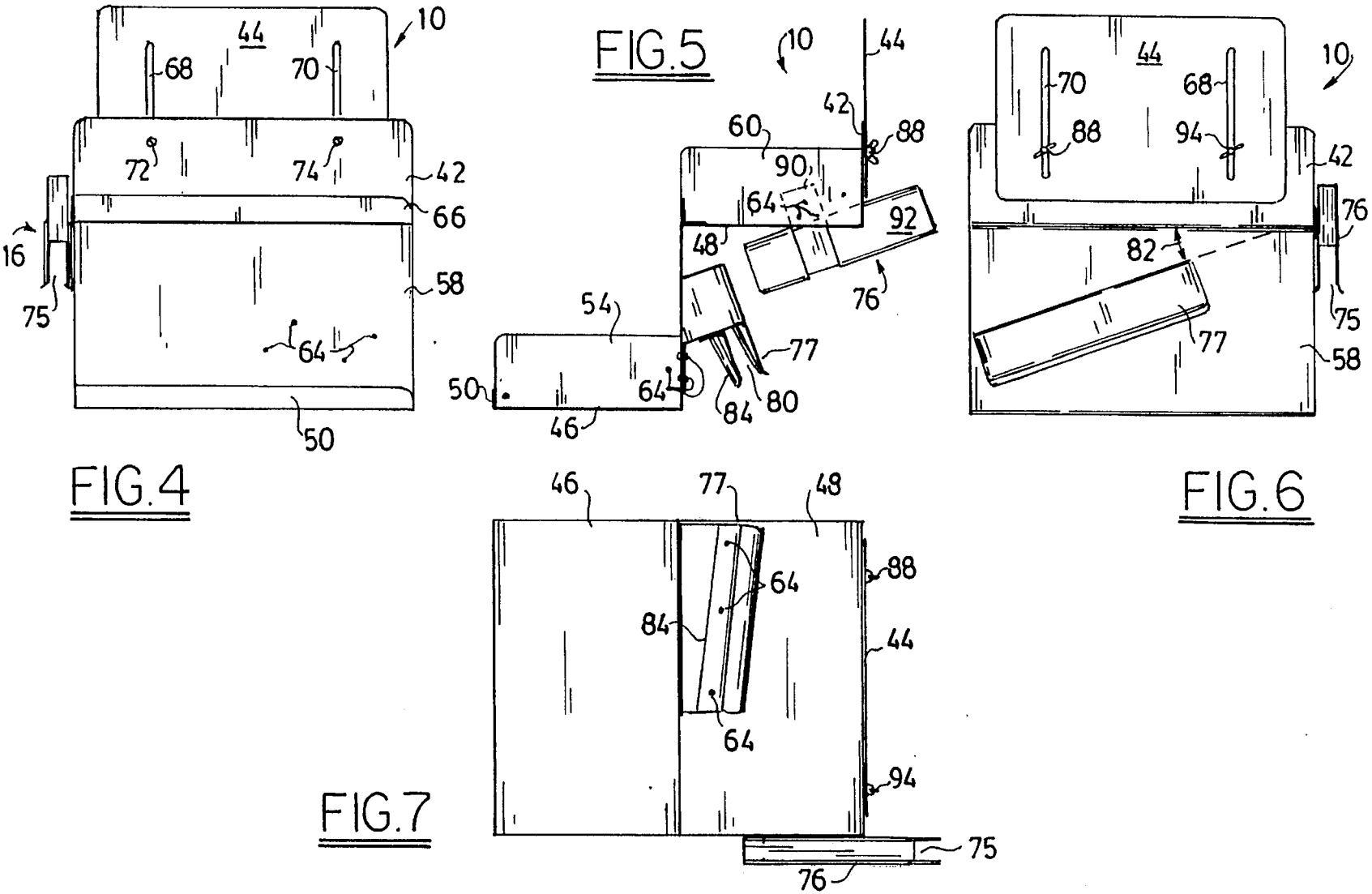
FIG. 4 is a front view of the letter holding tray of FIG. 1.
FIG. 5 is first side view of the letter holding tray of FIG. 1.
FIG. 6 is a back view of the letter holding tray of FIG. 1.
FIG. 7 is a bottom view of the letter holding tray of FIG. 1.

FIG. 4 is a front view of holder 10.

FIG. 5 is a side view of holder 10. It will be noted that wing nut 88 and another wing nut (not shown) may be used to removably attach slide plate 44 to back wall 42 of shelf 34. Referring to FIG. 5, it will be seen that tab 90 is preferably cut from wall 92 of attachment means 76 and bent upwardly prior to the time tab 90 is joined to wall 60 by means of rivets 64.

FIG. 6 is a back view of holder 10. Referring to FIG. 6, it will be seen that wing nuts 88 and 94 are used in conjunction with fasteners 72 and 74 (see FIG. 4) to removably attach slide plate 44 to wall 42 and to adjust its height.

FIG. 7 is a bottom view of the holder 10 of FIG. 1.

Figure 8:
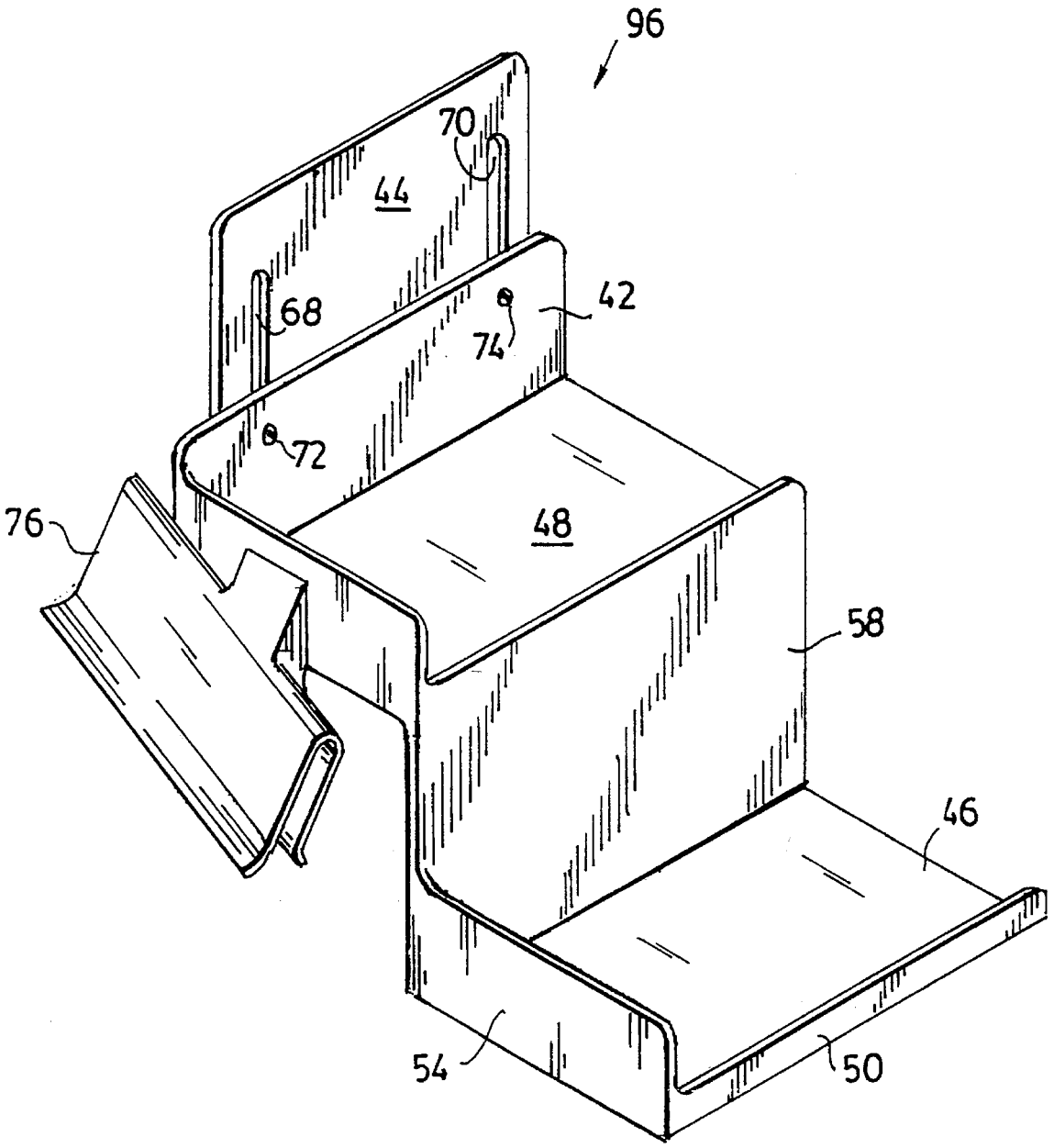
FIG. 8 is a perspective view of another preferred embodiment of applicant's letter holding tray.

FIG. 8 is a perspective view of another preferred embodiment 96 of applicant's invention. Mail holder 96 is preferably a substantialy integral device (with the exception of slide plate 44) which is integrally formed from plastic formed by conventional plastic forming means. Thus, e.g., one may use the plastics and the plastic forming means described in Joel Frados' "Plastics Engineering Handbook", Fourth Edition (Van Nostrand Reinhold Company, New York, 1976).

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An apparatus for holding mail, wherein said apparatus is adapted to be removably mounted on a four-sided letter tray comprised of a first front wall and a first side wall, wherein:

(a) said apparatus is comprised of a first three-sided shelf which is comprised of a first, vertically-extending back wall and, integrally connected to and disposed in back of said first vertically-extending back wall of said three-sided shelf, a second three-sided shelf, wherein said second three-sided shelf is comprised of a vertically-extending front wall, a vertically-extending side wall, a second vertically-extending back wall, and a horizontally-extending bottom wall;

(b) said apparatus is comprised of means for varying the height of said second vertically-extending back wall;

(c) said apparatus further comprises means for removably and simultaneously connecting said apparatus to the first front and the first side wall of the four-sided letter tray, which means is comprised of a first substantially U-shaped slide bar and a second substantially U-shaped slide bar, wherein said first substantially U-shaped slide bar is attached to said first, vertically-extending back wall.

2. The apparatus as recited in claim 1, wherein said second substantially U-shaped slide bar is attached to said second three-sided shelf.

3. The apparatus as recited in claim 2, wherein said second substantially U-shaped slide bar is attached to said vertically-extending side wall of said second three-sided shelf.

4. The apparatus as recited in claim 3, wherein said first substantially U-shaped slide bar is attached to said first vertically-extending back wall by means of steel rivets.

5. The apparatus as recited in claim 4, wherein said second substantially U-shaped slide bar is attached to said vertically-extending side wall of said second three-sided shelf by means of steel rivets.

6. An apparatus for holding mail, wherein said apparatus is adapted to be removably mounted on a four-sided letter tray comprised of a first front wall and a first side wall, wherein:

(a) said apparatus is comprised of a first three-sided shelf which is comprised of a first, vertically-extending back wall and, integrally connected to and disposed in back of said first vertically-extending back wall of said three-sided shelf, a second three-sided shelf, wherein said second three-sided shelf is comprised of a vertically-extending front wall, a vertically-extending side wall, a second vertically-extending back wall, and a horizontally-extending bottom wall;

(b) said apparatus further comprises means for removably and simultaneously connecting said apparatus to the first front and the first side wall of the four-sided letter tray, which means is comprised of a first substantially U-shaped slide bar and a second substantially U-shaped slide bar, wherein said first substantially U-shaped slide bar is attached to said first, vertically-extending back wall.

* * * * *